US005924523A

United States Patent [19]

Krause

[11] Patent Number: 5,924,523

[45] Date of Patent: Jul. 20, 1999

[54] ADJUSTABLE LADDER

[75] Inventor: Guenther Krause, Alsfeld, Germany

[73] Assignee: Krause-Werk GmbH & Co. KG, Alsfeld-Altenburg, Germany

[21] Appl. No.: 09/062,458

[22] Filed: Apr. 17, 1998

[30] Foreign Application Priority Data

Apr. 19, 1997 [DE] Germany ..... 297 07 101

[51] Int. Cl.[6] ..... E06C 7/06

[52] U.S. Cl. ..... 182/211; 182/207

[58] Field of Search ..... 182/207, 209, 182/210–214

[56] References Cited

U.S. PATENT DOCUMENTS 5,117,943 6/1992 Schmitt et al. ..... 182/213

*Primary Examiner*—Daniel P. Stodola
*Assistant Examiner*—Hugh B. Thompson
*Attorney, Agent, or Firm*—Flynn, Thiel, Boutell & Tanis, P.C.

[57] ABSTRACT

An adjustable ladder includes a base ladder and at least one extendable ladder movably fastened on the base ladder, the extension of which ladder can be locked by a locking bracket pivotally fastened on the extendable ladder. Locking is operated by a cable line running over guide rollers that are fixed on the base ladder. The guide rollers are arranged on the base ladder below a rung thereof and can be fastened by a first plug element serving as a mounting. The mounting can be formed of a wire or rod-shaped blank and loops around a substantial portion of the hollow section of the rung. The mounting has a bent portion extending in the direction of a rung axis and extending through a hollow tube supporting the guide roller. The bent portion is fastened to a spar of the base ladder and extends through the spar. The bent portion projects with a first end piece from an outer cheek of the spar so far that the end piece can be fixed in the direction of the rung axis.

15 Claims, 8 Drawing Sheets

ADJUSTABLE LADDER

FIELD OF THE INVENTION

The invention generally relates to an adjustable ladder including at least two ladder elements, which ladder elements are formed of spars and rungs having a square, preferably quadratic hollow section. The ladder elements are embodied by a base ladder and an extendable ladder movably fastened on the base ladder, the extension of which ladder can be locked by means of a locking bracket pivotally fastened on the extendable ladder. The locking is controlled by means of a cable line running over guide rollers, which guide rollers are fixed on the base ladder.

BACKGROUND OF THE INVENTION

Such a ladder is disclosed in U.S. Pat. No. 5,117,943. The cable mechanism used in this ladder makes it possible, by means of a simple, manual operation of the cable line, to release the locking of the ladder elements, to both extend and also retract the extendable ladder on the base ladder, and to subsequently again securely lock the reciprocal position of the ladder elements. In particular, when a telescopic change of the ladder must be carried out often, such an easily handled locking is very effective and time saving. The locking bracket, which is intended for a locking of this type, is pivotal by means of the cable line and is fastened on the extendable ladder. The locking bracket is thereby created in such a manner so as to be pivotable into the area of the base ladder such that it will rest on the next lower rung after the cable line operation has ended, and can only again be pivoted out of this position reciprocally locking the ladder elements after the extendable ladder has been slightly lifted against the force of gravity. The locking bracket is formed in such a manner that it subsequently, with the extendable ladder lifted, is pivoted by the rungs of the base ladder during passing without the cable line having to be operated; and after a brief subsequent return the locking bracket lockingly pivots or swings back. If the extendable ladder is instead supposed to be lowered on the base ladder, then the cable line is, also after a short lift, operated until the desired retraction of the extendable ladder is reached, which is thereafter further lowered until the locking bracket, as described, rests on the next rung of the base ladder. Aside from the advantages of such a ladder adjustable through a cable line, the known arrangement, however, has a relatively complicated design of the individual structural elements, which makes the manufacture of such a ladder unnecessarily more expensive. The multi-part locking bracket is pivotally supported on both sides on the spars by means of a special bearing block, which must each be screwed to one of the spars. Each of the utilized guide rollers is supported in a bearing housing, which has an eyelet in a bar extending over the cable, on which bar the bearing housing is pivotally suspended on the respective inner cheek of the adjacent spar. The known arrangement therefore requires many individual parts and a considerable amount of work during its installation on the ladder.

SUMMARY OF THE INVENTION

The basic purpose of the invention is therefore to provide a ladder of the type described above in such a manner that the described disadvantages are avoided and only a few simply designed and easily manufacturable individual parts are used, which parts can be installed together on the ladder without any special tools.

The purpose is attained according to the invention in such a manner that the guide rollers are arranged on the base ladder in each case below a rung and can be fastened by means of a first plug element serving as the mounting. The mounting or plug element is formed of a wire or rod-shaped blank, and on the one hand almost completely loops around the hollow section of the rung and is thereby bent in the direction of the rung axis, and on the other hand can be placed through a hollow axis or tube supporting the guide roller and fastened to a spar of the base ladder, the mounting extending through the spar and projecting with a first end piece over the outer cheek or surface of the spar far enough that it can be fixed in the direction of the rung axis.

The guide rollers in this manner do not require fastening on the spar of the base ladder through a connection created by screws, rivets or other machine elements. Rather, the guide rollers are mounted simply by means of the plug element. In this regard, one must merely ensure that the first end piece of the plug element projects over the outer cheek of the spar. The technical details of such a fixation are known to those skilled in the art and can be designed in many ways, for example, the end piece (or if necessary, the entire mounting) can be slightly widened when it is designed as a pipe-shaped hollow section. No technical skill and/or additional expense due to connecting bores, screw connections and the like are needed for this type of connection.

However, with such a design of the invention the problem of being able to install (and again remove) the mounting on (from) the completely premanufactured base ladder arises since the rungs cannot be released from the spars. The invention works around this difficulty by bending on the mounting a short second end piece which rests on one longitudinal side of the rung, whereby the bent second end piece is dimensioned such that when the mounting is released axially, the guide roller can be pivoted until the second end piece leaves its bearing position on the rung. It is then possible for the entire mounting moved along the rung axis (including the guide roller) to be lifted in such a manner that the loop can be pulled off from the section or profile of the rung. The assembly occurs in the reversed sequence.

It is particularly advantageous when the guide rollers are arranged in such a manner that the cable line is adjacent to a side of the locking bracket which faces the ladder axis, so that the mounting can no longer be moved easily in the direction of the rung axis when the mounting is bent on the front side of the guide roller, which front side faces to the ladder axis, and the outer cheek of the associated spar, as already described above, is fixed in such a manner that the guide roller is axially locked.

It has indeed been accomplished with this arrangement to fasten the guide rollers on the spar of the base ladder solely through a first plug connection.

A further plug connection can be provided when the locking bracket includes lateral swivel plates adjacent to the inside cheek of a spar of the extendable ladder and a traverse connecting the swivel plates with one another. In such an arrangement it is possible to provide a linch pin on each spar of the extendable ladder serving as a further plug element, whereby each of the swivel plates are then advantageously supported about a swivel axis of the linch pin, and the linch pin can be placed through a passage provided in the associated spar, and can be fixed axially on said spar.

A special bearing block on each side of the locking bracket is thereby not needed, rather it is sufficient to let the linch pin slightly project in a similar manner as the mounting on the base ladder over the outer cheek of the associated spar on the extendable ladder and to fix same in a suitable technically common manner in the direction of the linch pin axis, for example through a retaining ring or the like. The second plug element is thus a simple, and easily manufacturable swivel part, which must neither be adapted nor screwed in during assembly.

It is thereby advantageous when the swivel plates are designed essentially disk-shaped and each include a bar connected through a connecting piece to a locking finger in such a manner that the locking finger can be pivoted into the area of the base ladder, where it serves as a bearing or resting stop on a rung, and the bar is arranged in the area of the extendable ladder. The locking bracket is held stable in this position when a spring is arranged on the linch pin in such a manner that by the action of the spring, the locking bracket is pivoted or swung so that its locking fingers extend into the area of the base ladder. This position is accordingly, against the action of the spring, only overcome by the locking bracket being operated by means of the cable line or (during extension of the extendable ladder) by a rung. The locking bracket subsequently assumes its earlier position immediately under the influence of the spring. The spring is advantageously designed as a torsion spring, the first spring end of which rests on the locking bracket and the second spring end of which rests on the adjacent rung of the extendable ladder.

The operation of the locking bracket by means of the cable line can occur easily in such a manner by providing a holding piece, which holding piece is fastened on a swivel plate and preferably covers the linch pin. A cable shoe is provided on the holding piece for fastening of a first cable end of the cable line, which can, for example, be clamped in the cable shoe. A second cable end of the cable line can be fixed in a suitable manner, for example, the second cable end can be connected to a rung of the extendable ladder.

A preferred embodiment of the invention includes an angled or bent connecting plate for fastening of the traverse, which connecting plate is provided in each case on the bar of the swivel plates. The traverse, when the spring is relaxed, underpins the rung of the extendable ladder, which rung is adjacent to the swivel plates, so far that the traverse is oriented under said rung. Since this is always the case when the locking bracket is not released, it can be assured in this manner that during the use of the ladder the traverse, which is not designed for this purpose, cannot be stepped upon and thereby cannot be deformed.

The arrangement of the guide rollers and the locking of the cable line are particularly simple when a third plug element formed out of a wire or rod-shaped blank is adjusted on at least one of the guide rollers as a position lock for guiding the cable line in the area of the guide roller and/or for the axial fixation of the guide roller in direction of the rung axis toward the adjacent spar so that the assembly of the inventive arrangement is very simple. It is, for example, possible that the position lock includes a holding web which can be placed into a groove of the hollow axis or tube for the guide roller, with each bar piece enclosing the guide roller radially on two oppositely lying points of the circumference or periphery thereof, and a bar end bent at each bar piece, which can thus be premanufactured as a simple part, for example by means of a suitable template.

Its installation is particularly safe and economical when a clamping piece rests on the front side of the guide roller, which front side is directed toward the ladder axis. The clamping piece is guided with a bent lock against rotation on the adjacent rung, and a recess in the area of each of the bar ends of the position lock, into which recess the respective bar end extends, so that all participating structural parts remain in a fixed reciprocal orientation.

As a whole, the ladder of the invention offers an installation friendly, easily operable solution to the above discussed problems, which through the inexpensive plug design of the most important operating elements is best suited in particular for ladders, which as bulk articles must be designed safely and inexpensively.

The invention is not limited to two-part adjustable ladders, but can also be successfully used in an arrangement including several extendable ladders.

BRIEF DESCRIPTION OF THE DRAWINGS

The invention will be discussed in greater detail hereinafter in connection with one exemplary embodiment and the drawings, in which.

DETAILED DESCRIPTION

Figure 1:
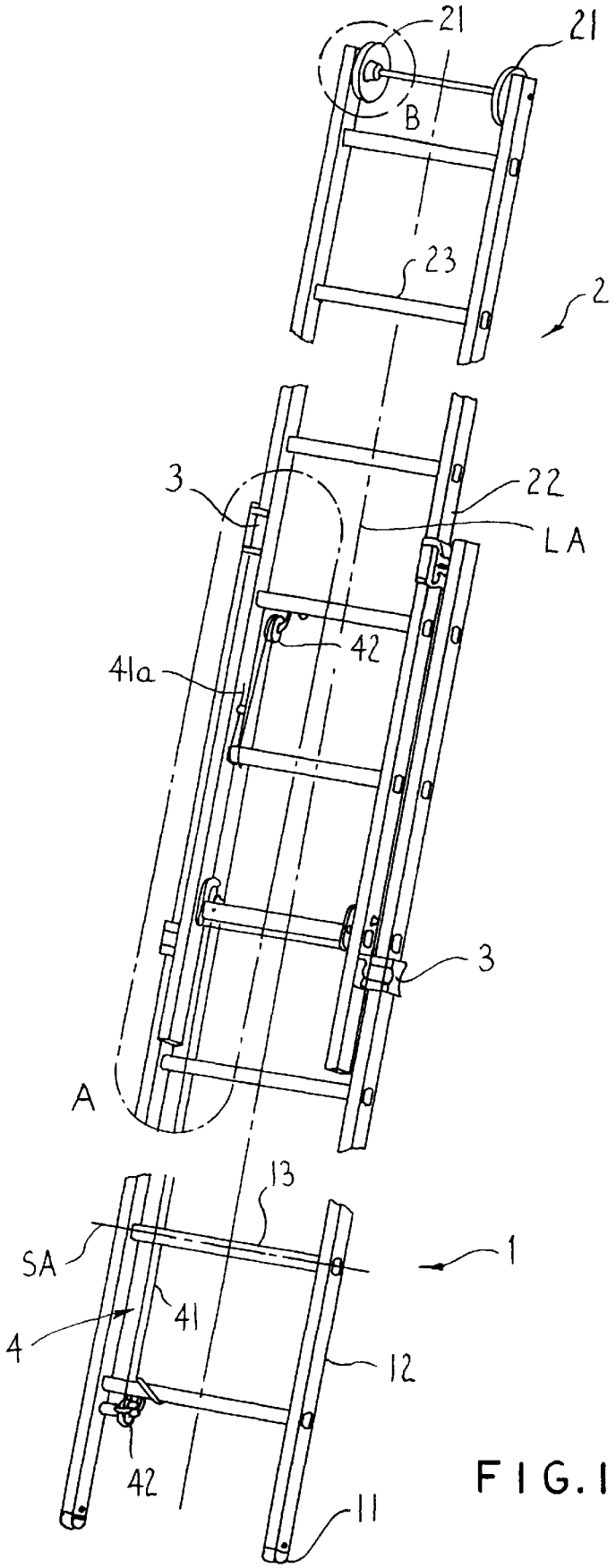
FIG. 1 is a three-dimensional overview drawing of an adjustable ladder according to the invention in a position of use.

An inventive, adjustable ladder includes, as shown in FIG. 1, two reciprocally telescopically adjustable ladder elements 1, 2. A base ladder 1 forms the ladder element, which can be placed on the ground with its feet 11. An extendable ladder 2 is guided elevationally adjustably on said ladder element 1. The adjustable ladder can be placed, for example, against a wall of a building by means of bearing rollers 21 at the top of the extendable ladder 2.

The ladder elements 1, 2 are each composed of a pair of vertical spars 12, 22 and rungs 13, 23 connecting the spars 12, 22. Both the spars 12, 22 and also the rungs 13, 23 are designed as hollow sections 13*a*, 23*a* (FIG. 5) in cross section, the hollow sections 12*a*, 22*a* of the spars 12, 22 (FIG. 6) having a rectangular cross section, and the hollow sections 13*a*, 23*a* (FIGS. 5, 7) of the rungs 13, 23 having a square cross section. The ladder elements 1, 2 are completely prefabricated and the rungs 13, 23 are fixedly connected to the spars 12, 22, for example, by a jointed flanging (FIG. 8). Guide and stop elements 3 take care that the slightly narrower extendable ladder 2 is guided easily movably parallel to the base ladder 1 and that the extension thereof is limited.

This extension is accomplished by means of a cable 4, which cable essentially includes a cable 41 with two cable ends 41*a*, 41*b* and two guide rollers 42 for the cable 41. The cable 41 is arranged in such a manner that both strands thereof extend approximately parallel to the spars 12, 22. Both guide rollers 42 are mounted on the (in FIG. 1 the left) spar 12 of the base ladder 1, whereas the two cable ends 41*a*, 41*b*, are mounted on the extendable ladder 2.

A first cable end 41*b* is thereby (FIGS. 2, 4–6) fastened on a locking bracket 5 in a manner described in greater detail below, whereas a second cable end 41*a* corresponding to FIG. 2, looped several times around a rung 23 of the extendable ladder 2, is clamped together with the strand of the cable line 41 with a clamp sheet metal plate 43, which plate 43 is fastened to the adjacent spar 22.

Figure 2:
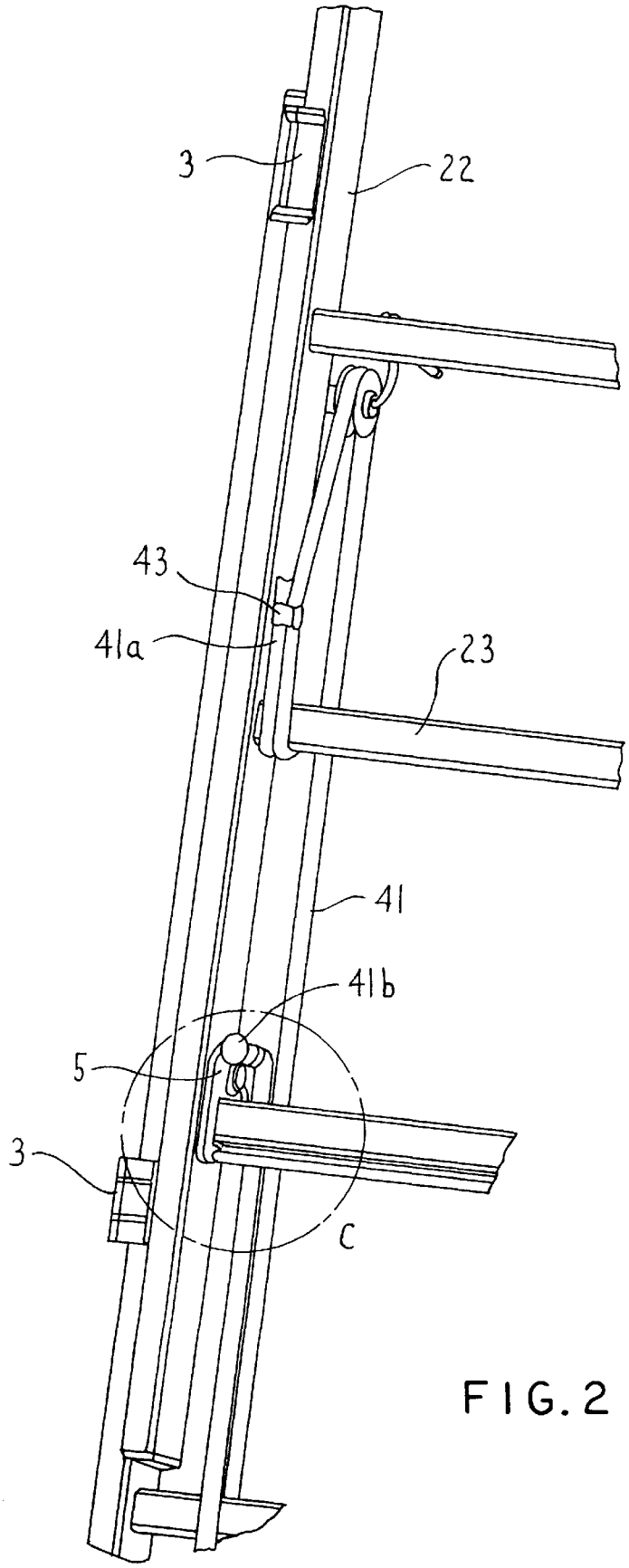
FIG. 2 is a detail A of FIG. 1, enlarged.
Figure 3:
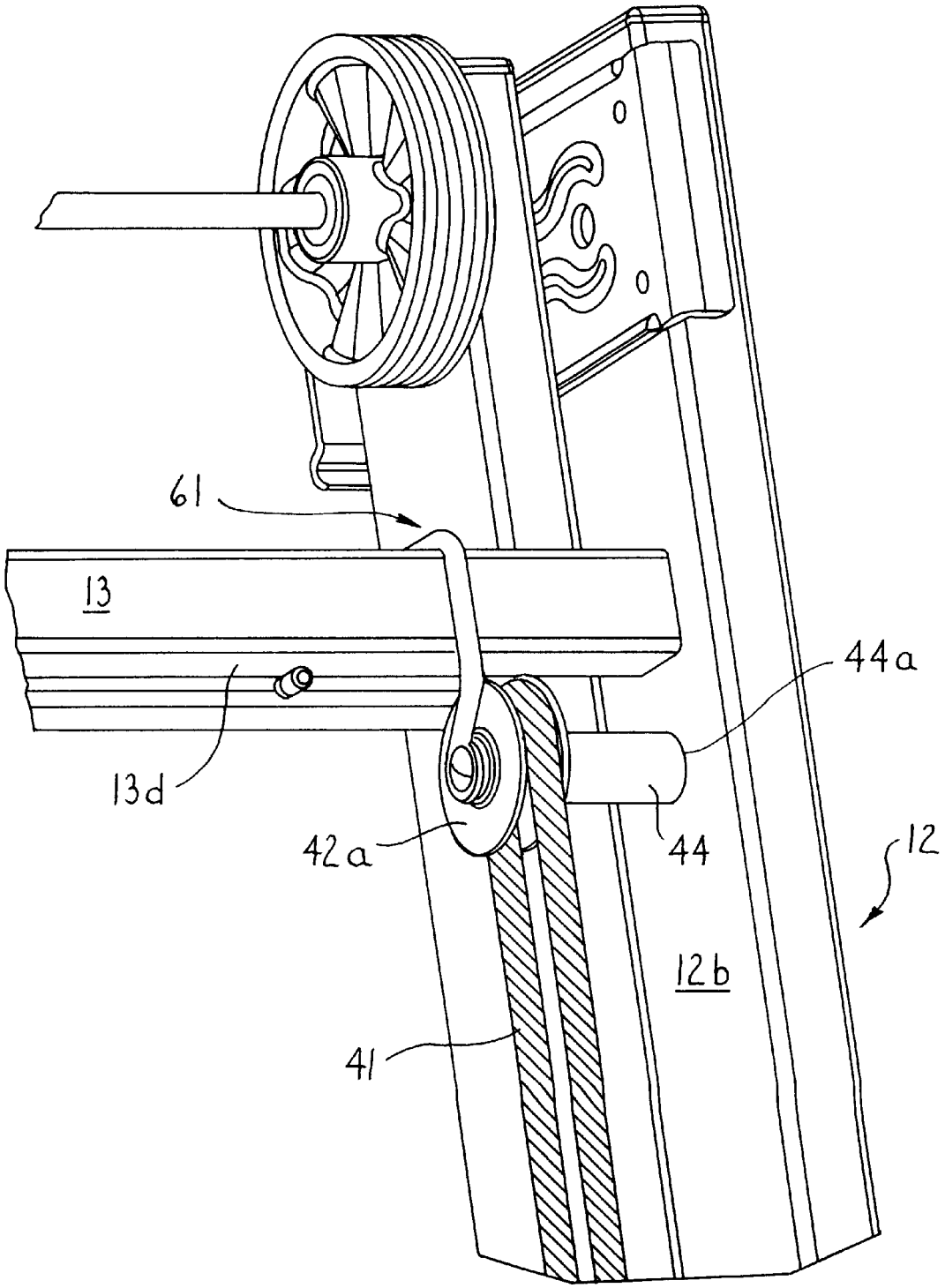
FIG. 3 is a detail B of FIG. 1, however, rotated at 180° and enlarged.
Figure 4:
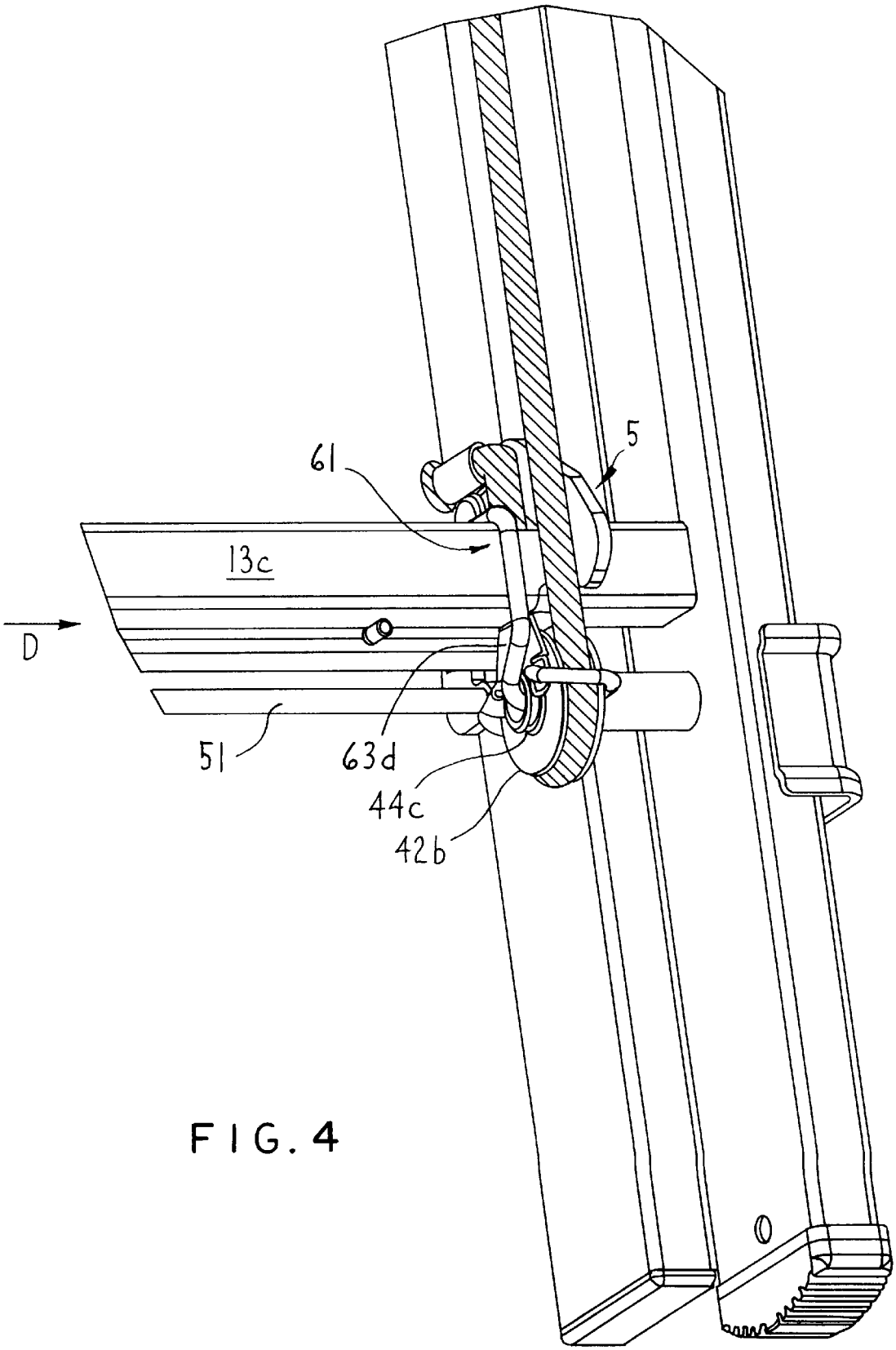
FIG. 4 is a detail C of FIG. 2, rotated at 180° and enlarged.

An upper guide roller 42*a* is illustrated in FIGS. 2 and 3 which includes the cable 41 running on said guide roller 42*a*. It can be recognized that the guide roller 42*a* is rotatably supported on a hollow axis or tube 44, and abuts with an annular collar 44*a* on the inner cheek 12*b* of the spar 12. The tube 44 is guided through the spar 12, and projects over the outer cheek 12*c* of the spar 12, and is axially fixed thereon in a suitable manner (FIG. 8). A further lower guide roller 42*b* is supported in a similar manner on a hollow axis or tube 44 (FIGS. 4, 8).

The guide rollers 42 are fastened (FIGS. 3, 4) on the associated hollow tubes or axes 44 each by means of a mounting 61, which forms a first one of several plug elements, which facilitate together a quick and simple assembly of the various operating elements. The mounting 61 is thereby bent out of a rod-shaped blank so that an incomplete or open loop having pieces 61*a–d* is formed in such a manner that the next rung 13 above the hollow axis or tube 44 is almost completely enveloped by the loop pieces 61*a–d* resting against its cheeks or surfaces 13*b–e*. The loop piece 61*b* is thereby angled in the area of lateral cheek 13*e* in such a manner that a short (second) end piece 61*a* resting on the lower cheek 13*d* is laterally offset relative to the loop piece 61*c* lying on the upper cheek 13*b*. A further loop piece 61*d* resting on the lateral cheek 13*c* (FIG. 5) obtusely angles over into a stop piece 61*e*, which stop piece 61*e* is bent out of a longitudinal piece of the mounting 61. Stop piece 61*e* extends through the hollow axis or tube 44, in such a manner that the respective guide roller 42 is locked axially in a direction of the ladder axis LA (FIG. 1). The longitudinal piece or stop piece 61*e*, with a (first) end piece 61*f*, projects slightly from the outer cheek 12*c* of the spar 12 that the stop piece 61*e* can be easily releasably locked thereat in a suitable manner (FIG. 8) so that the mounting 61 is fixed in direction of the rung axes SA (FIG. 1). The bending pieces 61*a–d* and stop piece 61*e* are indicated on the mounting 61 in FIG. 5 for a better understanding.

The mountings 61 can be easily demounted after the locking has been released; they are for this purpose moved first parallel to the rung axis SA toward the ladder axis LA and, when they have been removed from the area of the hollow axis or tube 44, are pivoted alone or together with the guide roller 42*b* until the end piece 61*a* is sufficiently spaced from the lower cheek 13*d* in order to be able to be pulled off from the rung 13 during a further pivoting about the rung axis SA, with the assembly taking place in the reverse sequence. The mounting and demounting operation is thus a pure plugging operation, which is merely supplemented by the locking/unlocking pivoting movement in the direction of the rung axis SA.

Figure 5:
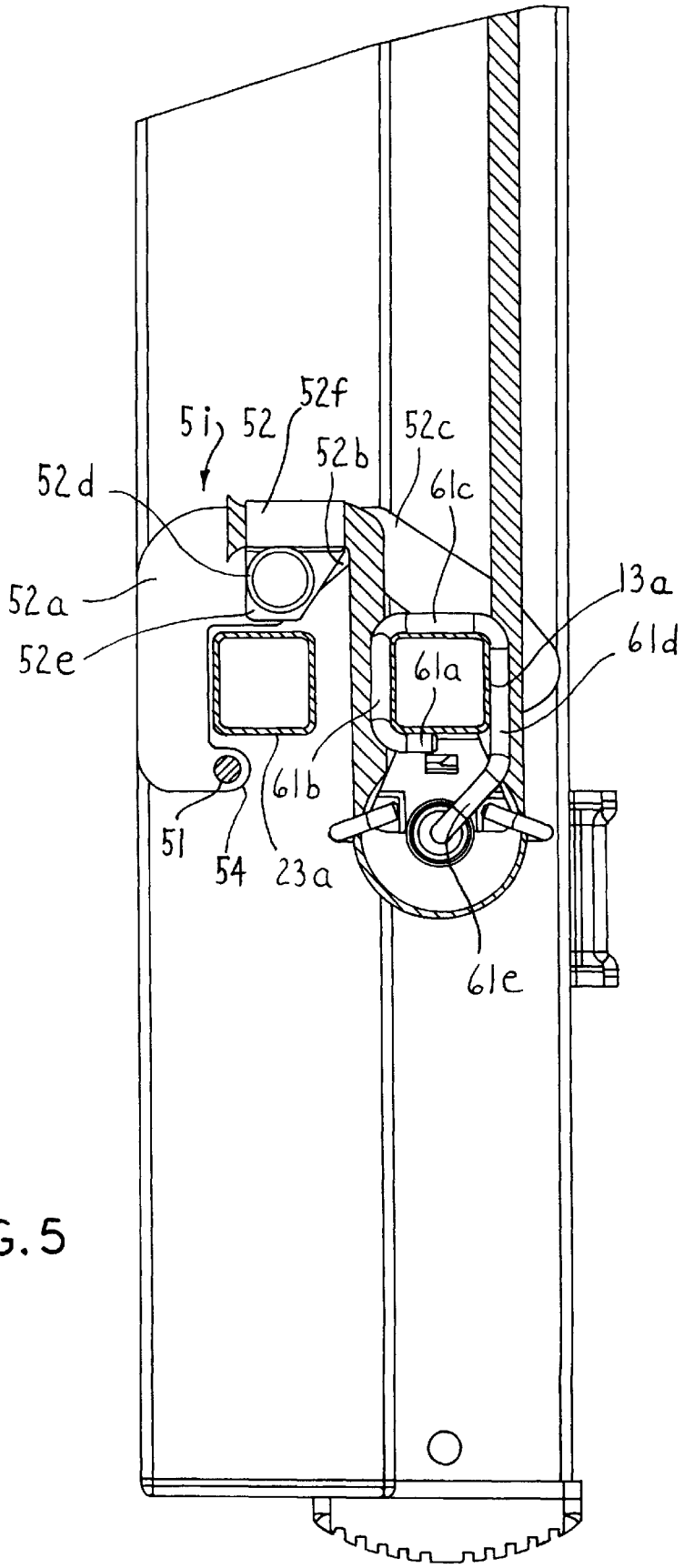
FIG. 5 is a view D of FIG. 4.
Figure 6:
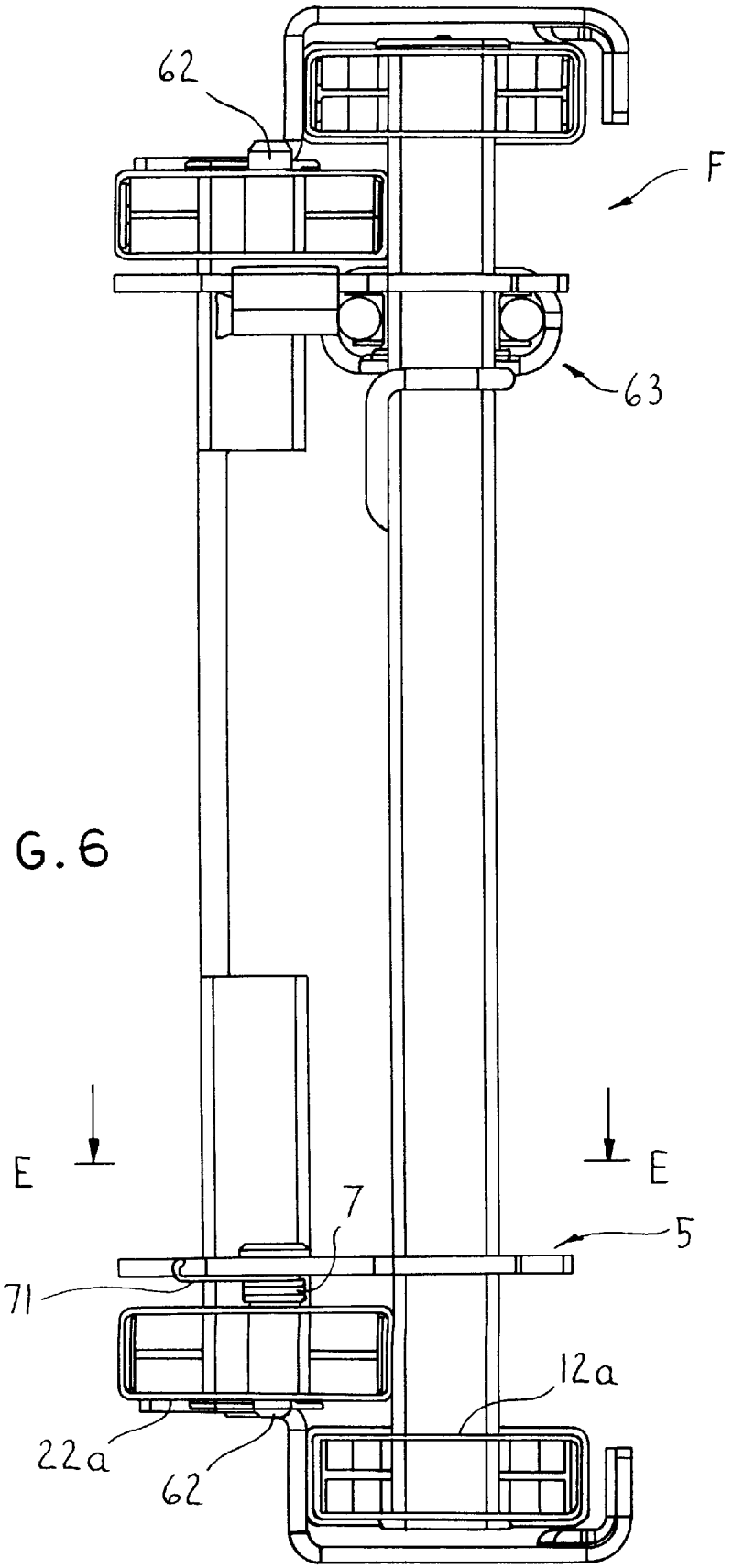
FIG. 6 is a top view of the view D in FIG. 5.
Figure 7:
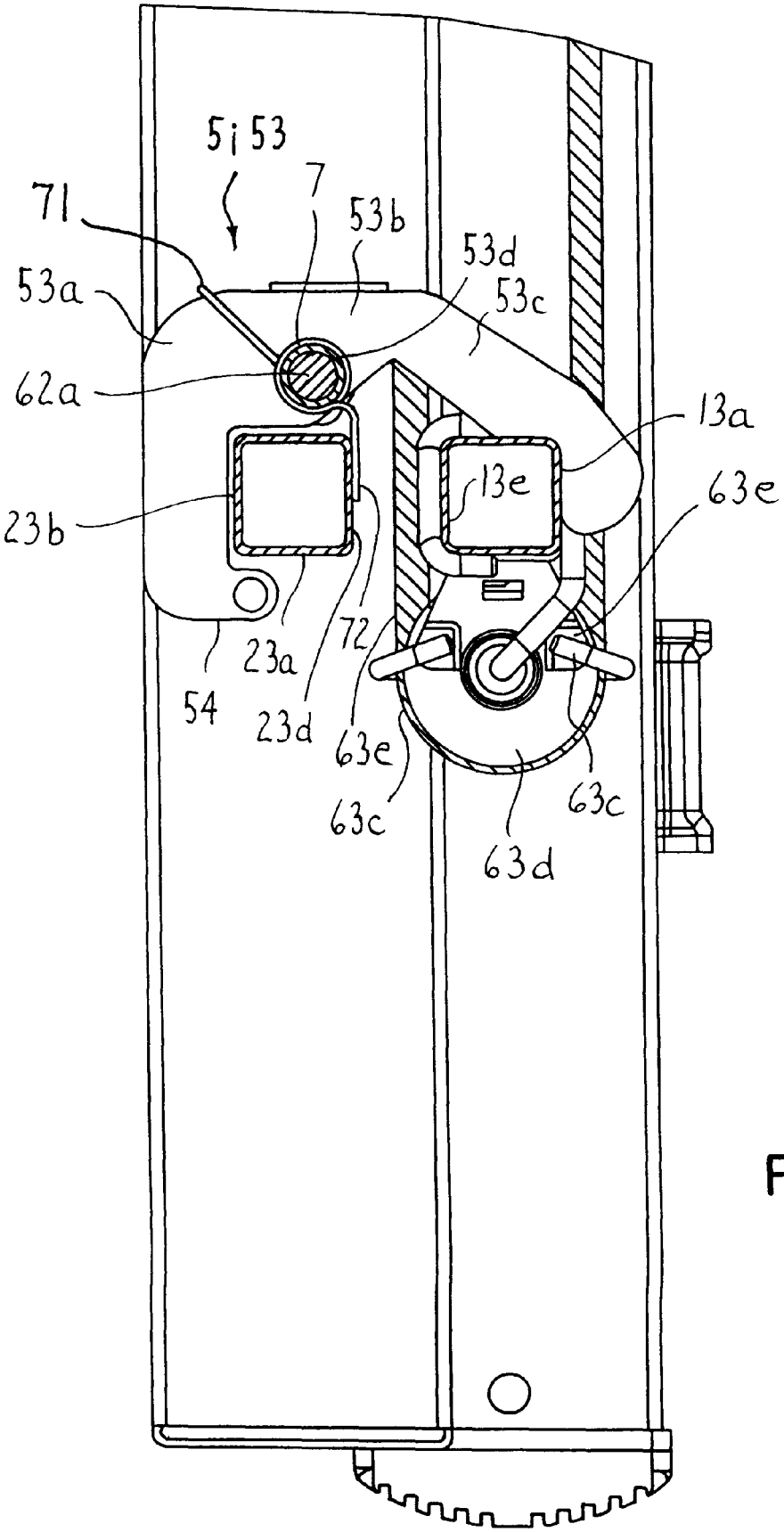
FIG. 7 is a cross-sectional view E—E of FIG. 6, rotated at 180°.
Figure 8:
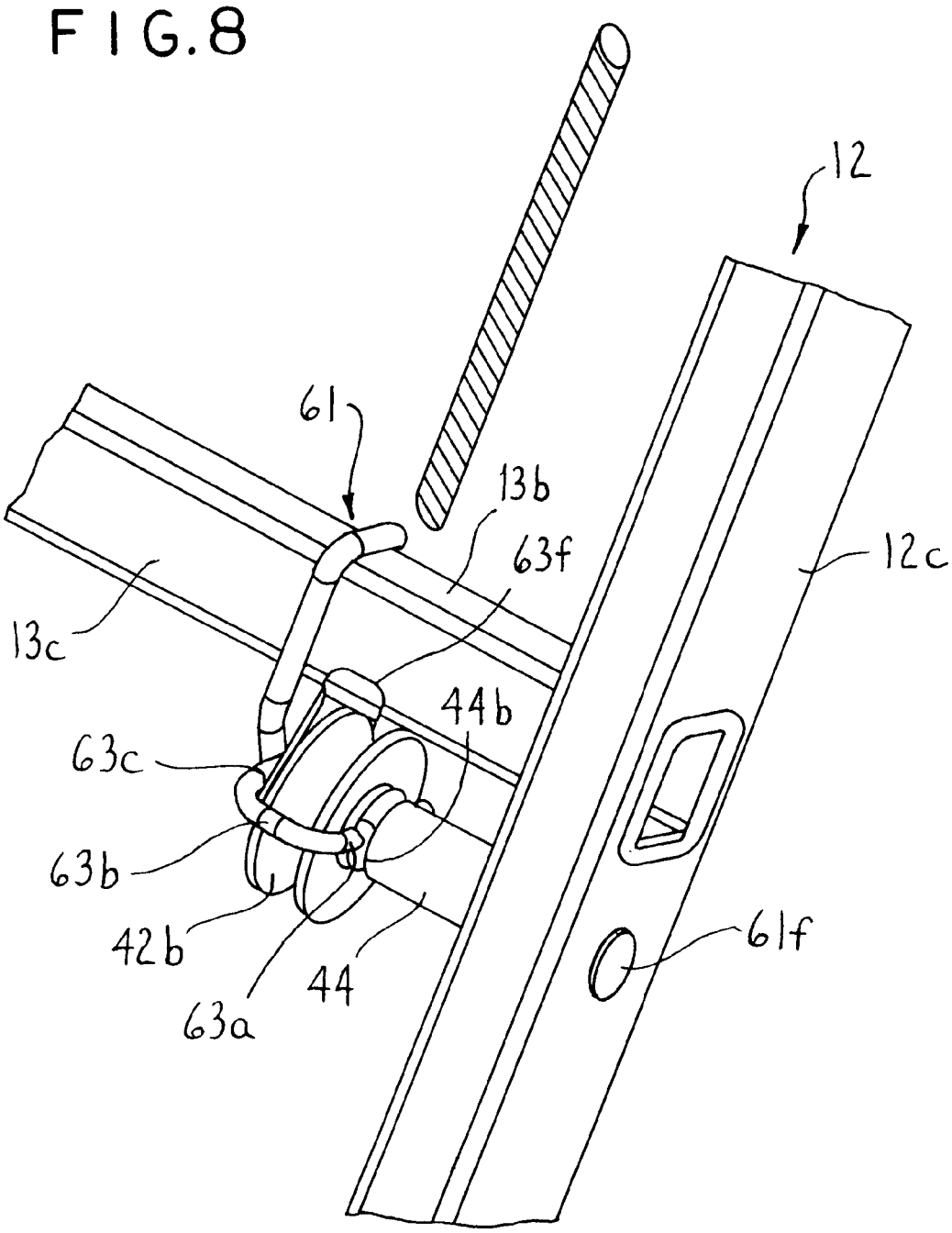
FIG. 8 is a three-dimensional view F of FIG. 6, all in a schematically simplified illustration.

Two further plug elements are illustrated in detail in FIGS. 4–8, one of which elements is used as a linch pin 62 for mounting the locking bracket 5 onto the spars 22 of the extendable ladder 2, and another one of which is used as a position lock 63 for the cable 41, in particular on the lower guide roller 42*b* (FIG. 5).

The locking bracket 5 includes a traverse 51 with a swivel plate 52, 53 non-rotatably fastened to said traverse 51 at both ends thereof. The disk-shaped swivel plates 52, 53 are each pivotally supported about a swivel axis 62*a* of each of the linch pins 62 and have—in the area of the extendable ladder 2—a bar 52*a*, 53*a* for mounting the traverse 51, and each includes one locking finger 52*c*, 53*c* connected to the bar 52*a*, 53*a* through a connecting piece 52*b*, 53*b*. A shaft bearing 52*d*, 53*d* is provided on each of the connecting pieces 52*b*, 53*b* (FIGS. 5, 7) about the swivel axis 62*a*. A torsion spring 7 is mounted about the swivel axis 62*a* in the area of the connecting piece 53*b* (FIG. 7), and a holding piece 52*e* with an attached cable shoe 52*f* for fastening of the first cable end 41*b* is provided on the other connecting piece 52*b*, which holding piece 52*e* covers there the swivel axis 62*a*. The torsion spring 7 is arranged so that a first spring end 71 thereof rests on the bar 53*a* and biases the bar 53*a* about the swivel axis 62*a* against a cheek 23*b* of the rung 23, whereas a second spring end 72 is disposed against the oppositely lying cheek 23*d*. The arrangement is accordingly such that a pivoting of the locking fingers 52*c*, 53*c* out of the adjusting area of the base ladder 1 occurs at all times against the force of the torsion spring 7, during the operation of the cable line 4 or when the locking fingers 52*c*, 53*c* hit the rungs 13 during lifting of the extendable ladder 2. FIG. 4 furthermore shows easily that the locking fingers 52*c*, 53*c* are configured to extend over and slightly grip the respective rung 13 so that they rest partially on the lateral cheek 13*c* of the rung 13, and the ladder elements 1, 2 are therefore reciprocally locked. This locking can only be cancelled or released by slightly lifting the extendable ladder 2 far enough that the locking fingers 52*c*, 53*c* leave the area of the cheek 13*c* of the respective rung 13 and pivot in a clockwise manner (with respect to FIGS. 5 and 7) due to the abutment of the upper surfaces of the locking fingers 52*c*, 53*c* with the underside of the adjacent upper rung 13.

The traverse 51 remains always under the rung 13 prior to such a pivoting of the entire locking bracket 5 (including the traverse 51) and is protected against being stepped on. The bars 52*a*, 53*a*, for this purpose, each terminate in a bent or angled connecting plate 54, on which the traverse 51 is fastened.

An additional plug element is formed by a position lock 63, which serves to fix the lower guide roller 42*b* on the associated hollow axis or tube 44 and also secures the looping cable 41. The position lock 63 is formed of a wire or rod-shaped blank and includes a holding web 63*a*, which can be placed into a groove 44*b* of the hollow axis or tube 44 for the guide roller 42*b*, and bar pieces 63*b* following the holding web 63*a*, which bar pieces 63*b* cover or extend over the cable 41 on the oppositely lying sides of the guide roller 42*b* and (FIG. 7) end in bent or angled bar ends 63*c*.

These bar ends 63*c* can engage each one recess 63*e*, which is provided in a clamping piece 63*d*. The clamping piece, by means of the abutting mounting 61, is placed against the front side of the guide roller 42*b*, which front side faces toward the ladder axis LA, and (FIG. 8) is prevented from rotating by means of a bent portion 63*f* which abuts against the adjacent rung 13. FIG. 4 shows that a circular groove 44*c* can be provided on the hollow axis or tube 44, in which groove 44*c* the clamping piece 63*d* is guided.

The embodiments of the invention in which an exclusive property or privilege is claimed are defined as follows:

1. An adjustable ladder including at least two ladder elements formed of spars and rungs having a generally square hollow section, said at least two ladder elements comprising: a base ladder and at least one extendable ladder movably fastened on said base ladder, an extension of said extendable ladder being lockable to said base ladder by a locking bracket pivotally fastened on said extendable ladder, whereby a cable line running over guide rollers operates said locking bracket and said guide rollers are fixed on said base ladder, wherein said guide rollers are arranged on said base ladder below a rung thereof and are fastened by a first plug element serving as a mounting, whereby said mounting is formed of a wire or rod-shaped blank, said mounting looping around a substantial portion of a hollow section of the at least one rung, said mounting having a bent portion extending in the direction of a rung axis and extending through a hollow tube supporting one of said guide rollers, the bent portion being fastened to a spar of said base ladder and extending through said spar, the bent portion projecting with a first end piece from an outer cheek of said spar so far that said end piece is fixed in the direction of the rung axis.

2. The adjustable ladder according to claim 1, wherein a short second end piece of said mounting rests on one longitudinal side of the rung, whereby said second end piece and the bent portion are dimensioned such that, with said mounting being released, said mounting and one of said guide rollers are pivotable until said second end piece leaves a bearing position on the at least one rung.

3. The adjustable ladder according to claim 1, wherein said guide rollers are arranged such that said cable line is adjacent a side of said locking bracket, facing a ladder axis.

4. The adjustable ladder according to claim 1, wherein said mounting is fixed on the outer cheek of said spar so that one of said guide rollers is axially locked.

5. The adjustable ladder according to claim 1, wherein said locking bracket includes two lateral swivel plates adjacent to an inside cheek of a spar of the extendable ladder, and a traverse connecting said swivel plates with one another.

6. The adjustable ladder according to claim 5, wherein on each of said spars of said extendable ladder there is provided a linch pin serving as a further plug element, and said swivel plates are each supported on a swivel axis of said linch pin, whereby said linch pin is placed through a passage provided in said spar and fixed axially on said spar.

7. The adjustable ladder according to claim 6, wherein said swivel plates are essentially disk-shaped and said swivel plates each include a bar, a connecting piece, and a locking finger, said connecting piece being connected to said bar and said locking finger at opposing ends thereof, such that said locking fingers pivot into one of the rungs of said base ladder serving as a bearing stop.

8. The adjustable ladder according to claim 7, wherein a spring is arranged on said linch pin such that said spring pivots said locking bracket so that said locking fingers extend into contact with one of the rungs of said base ladder.

9. The adjustable ladder according to claim 8, wherein said spring is constructed as a torsion spring, a first spring end resting on said locking bracket and a second spring end resting on an adjacent rung of said extendable ladder.

10. The adjustable ladder according to claim 9, wherein a holding piece fastens on one of said lateral swivel plates and covers said linch pin, said holding piece supporting a cable shoe receiving a first cable end of said cable line.

11. The adjustable ladder according to claim 10, wherein said bars of said swivel plates include an angled connecting plate securing said traverse, when said spring is relaxed, said traverse underpins one of the rungs of said extendable ladder, said rung being adjacent to the swivel plates, so that said traverse is oriented under said rung.

12. The adjustable ladder according to claim 6, wherein a third plug element formed out of a wire or rod-shaped blank is adjusted on at least one of said guide rollers as a position lock for guiding said cable line about said guide roller.

13. The adjustable ladder according to claim 12, wherein said position lock includes a holding web placed into a groove of said hollow tube of said guide roller, and said position lock includes bar pieces enclosing said guide roller radially on two oppositely lying points of its circumference, and each bar piece having a bar end with bent ends.

14. The adjustable ladder according to claim 13, wherein a clamping piece rests on a side of said guide roller, where said side is directed toward a ladder axis, said clamping piece being guided against rotation by a bent portion thereof resting on an adjacent one of the rungs, and each said clamping device has one recess in the bar ends of said position lock, into which said recess extends the respective bar end.

15. The adjustable ladder according to claim 6, wherein a third plug element formed out of a wire or rod-shaped blank is adjusted on at least one of said guide rollers as a position lock for axially fixing said guide roller in the direction of the rung axis toward one of said spars of said base ladder.

* * * * *